US005941201A

United States Patent [19]

Shimizu et al.

[11] Patent Number: 5,941,201

[45] Date of Patent: Aug. 24, 1999

[54] VALVE OPERATING SYSTEM IN INTERNAL COMBUSTION ENGINE

[75] Inventors: Yasuo Shimizu; Mitsuhito Yamazaki; Kenji Hirose; Atsushi Umemoto; Kouichi Ikoma, all of Saitama, Japan

[73] Assignee: Honda Giken Kogyo Kabushiki Kaisha, Tokyo, Japan

[21] Appl. No.: 08/914,993

[22] Filed: Aug. 20, 1997

[30] Foreign Application Priority Data

Aug. 21, 1996 [JP] Japan ..... 8-219872

[51] Int. Cl.[6] ..... F01L 9/04; F16K 31/06

[52] U.S. Cl. ..... 123/90.11; 251/129.01; 251/129.16

[58] Field of Search ..... 123/90.11; 251/129.01, 251/129.02, 129.05, 129.1, 129.15, 129.16

[56] References Cited

U.S. PATENT DOCUMENTS

| | | | |
|---|---|---|---|
| 4,719,882 | 1/1988 | Krueter | 123/90.11 |
| 4,955,334 | 9/1990 | Kawamura | 123/90.11 |
| 5,076,222 | 12/1991 | Kawamura | 123/90.11 |
| 5,350,153 | 9/1994 | Morinigo et al. | 251/129.16 |
| 5,515,818 | 5/1996 | Born | 123/90.11 |
| 5,671,705 | 9/1997 | Matsumoto et al. | 123/90.11 |
| 5,690,064 | 11/1997 | Izuo | 123/90.11 |

FOREIGN PATENT DOCUMENTS

| | | |
|---|---|---|
| 0 471 614 A1 | 2/1992 | European Pat. Off. . |
| 2192242 | 2/1974 | France . |
| WO-95/00959 | 1/1995 | WIPO . |

*Primary Examiner*—Weilun Lo
*Attorney, Agent, or Firm*—Lyon & Lyon LLP

[57] ABSTRACT

A valve operating system for an internal combustion engine includes a valve-opening electromagnet and a valve-closing electromagnet for exhibiting an electromagnetic force for attracting an armature to operate an engine valve, and a valve-opening resilient means and a valve-closing resilient means for maintaining the armature at a predetermined neutral position during deenergization of the electromagnets. In each electromagnet, a coil is inserted between inner and outer yokes which are disposed in the form of a double-cylinder such that they open at their ends opposed to the armature and are magnetically coupled to each other at their ends opposite from the armature, and the coil is positioned so that the coil protrudes from at least one of the yokes toward the armature. The armature has an annular accommodating portion provided in a surface thereof opposed to each the electromagnets and capable of accommodating that portion of the coil which protrudes from the yoke. With such a structure, it is possible to increase the electromagnetic attracting force of each of the electromagnets and to enhance the performance of the engine.

5 Claims, 6 Drawing Sheets

VALVE OPERATING SYSTEM IN INTERNAL COMBUSTION ENGINE

BACKGROUND OF THE INVENTION

1. Field of the Invention

The present invention relates to a valve operating system for an internal combustion engine and, in particular, to an electromagnetic type valve operating system, that includes an armature operatively connected to an engine valve, a valve-opening electromagnet for exhibiting an electromagnetic force for attracting the armature to open the engine valve, a valve-closing electromagnet for exhibiting an electromagnetic force for attracting the armature to close the engine valve, a valve-opening resilient means for exhibiting a resilient force for biasing the engine valve in a valve opening direction, and a valve-closing resilient means for exhibiting a resilient force for biasing the engine valve in a valve closing direction and for maintaining the armature at a predetermined neutral position by cooperation with the valve-opening resilient means during deenergization of the valve-opening and valve-closing electromagnets.

2. Description of the Related Art

Such a valve operating system is conventionally known, for example, from PCT International Patent Application Laid-open No. WO95/00959 and the like.

In such a valve operating system, the engine valve is in the neutral position when both the electromagnets are in their non-energized states. The armature is attracted to the valve-opening electromagnet by supplying an electric current to the valve-opening electromagnet to open the engine valve, and the armature is attracted to the valve-closing electromagnet by supplying the electric current to the valve-closing electromagnet to close the engine valve. To provide an enhancement in performance of the engine, it is desirable that an efficient magnetic circuit is formed between the armature and the valve-opening and valve-closing electromagnets, so that the electromagnetic attracting forces provided by the valve-opening and valve-closing electromagnets are increased.

SUMMARY OF THE INVENTION

Accordingly, it is an object of the present invention to provide an electromagnetic type valve operating system for an internal combustion engine, wherein the electromagnetic attracting forces provided by the valve-opening and valve-closing electromagnets can be increased, and the performance of the engine can be enhanced.

To achieve the above object, according to a first aspect and feature of the present invention, each of the valve-opening and valve-closing electromagnets includes a coil inserted between inner and outer yokes which are disposed in the form of a double-cylinder such that they open at their ends opposed to the armature and are magnetically coupled to each other at their ends opposite from the armature, the coil being positioned in the yokes so that the coil protrudes from at least one of the yokes toward the armature, and the armature has an annular accommodating portion provided in a surface thereof opposed to each the electromagnets and capable of accommodating that portion of the coil which protrudes from the yoke. Thus, when the armature is attracted to the electromagnet, a portion of each coil is accommodated in the annular accommodating portion. Therefore, an increase in magnetic flux between the armature and both the yokes can be provided by effectively utilizing a phenomenon that the magnetic field becomes highest on an end of the coil, thereby increasing the electromagnetic attracting force of each of the electromagnets.

According to another aspect and feature of the present invention, each of the valve-opening and valve-closing electromagnets includes a coil inserted between inner and outer yokes which are disposed in the form of a double-cylinder such that they open at their ends opposed to the armature and are magnetically coupled to each other at their ends opposite from the armature, and the ratio of the area of a magnetic path in the outer yoke to that in the inner yoke is set in a range of 1.0 to 1.4. Thus, the attracting force provided by each of the electromagnets can be increased by the fact that the ratio of the area of the magnetic path in the outer yoke to that in the inner yoke is set in the above-described range.

Further, according to a further aspect and feature of the present invention, at least the engine valve among the members located near the valve-opening and valve-closing electromagnets is formed from a non-magnetic lightweight material, and the engine valve portion contacting with another member formed of a non-magnetic lightweight material is subjected to a surface hardening treatment. The non-magnetic lightweight materials which may be used include a titanium alloy, an aluminum alloy, ceramics and the like. Therefore, it is possible to reduce the leakage of the magnetic flux from each of the electromagnets to contribute to an increase in electromagnetic attracting force of the electromagnets and to effectively operate the engine valve by reducing the weight of at least the engine valve in cooperation with the increase in electromagnetic attracting force.

The above and other objects, features and advantages of the invention will become apparent from the following description of the preferred embodiments taken in conjunction with the accompanying drawings.

BRIEF DESCRIPTION OF THE DRAWINGS

FIGS. 1 to 5 illustrate a first embodiment of the present invention, wherein FIG. 1 is a vertical sectional view of a valve operating system in a state where an engine valve is in a neutral position;

FIG. 2 is a cross sectional view of an electromagnet;

FIG. 3 is a side view of the engine valve;

FIG. 4 is a diagram showing the variation in attracting force with respect to the amount of coil protruding from yokes;

FIG. 5 is a diagram showing the variation in attracting force with respect to the magnetic path area ratio.

DETAILED DESCRIPTION OF THE PREFERRED EMBODIMENTS

Figure 1:
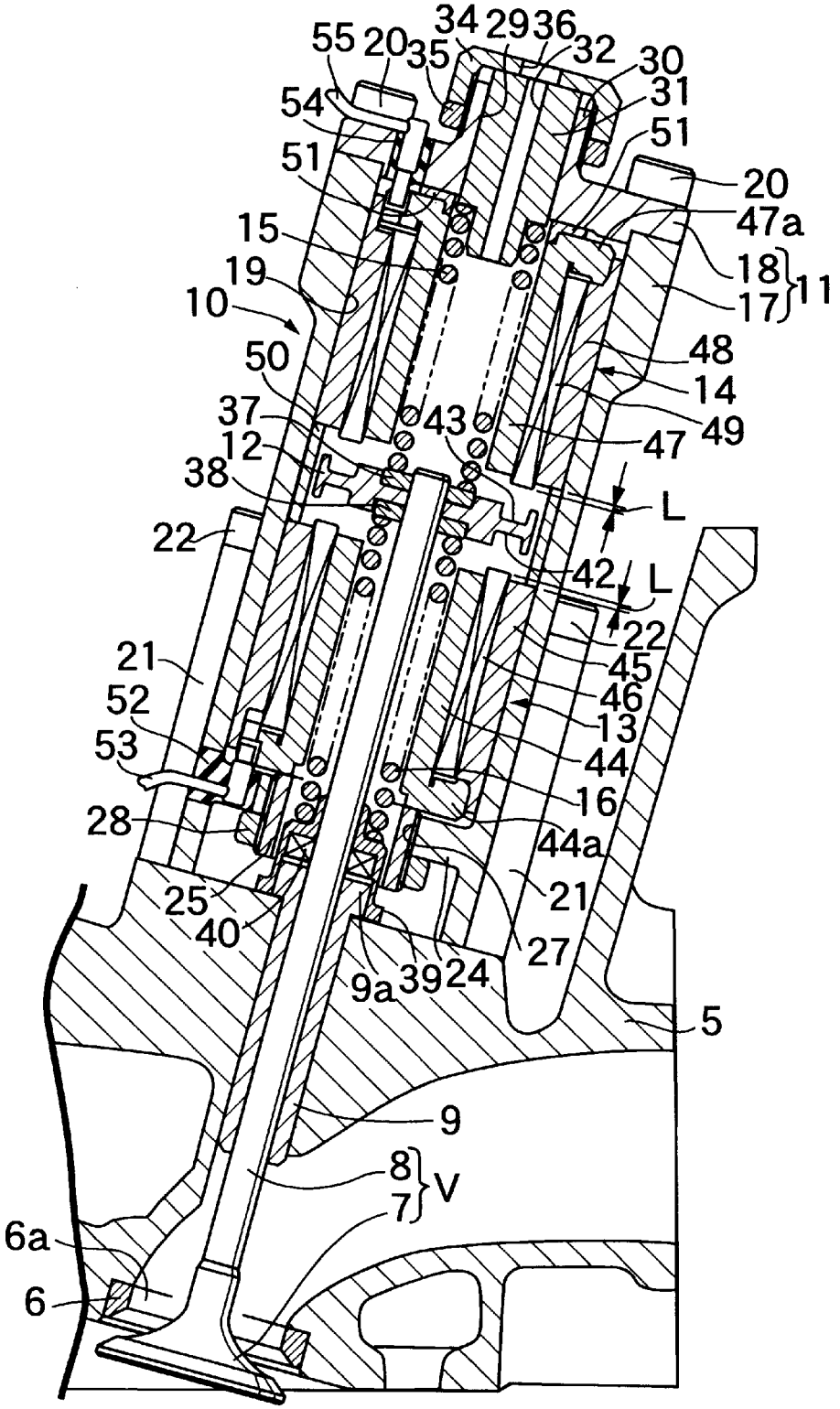

A first embodiment of the present invention will now be described with reference to FIGS. 1 to 5. Referring first to FIG. 1, the engine valve V, which is either an intake valve or an exhaust valve, is comprised of a valve member 7 capable of being seated on a valve seat member 6 which is provided in the cylinder head 5 to define a valve bore 6*a*, and a stem 8 integrally connected to the valve member 7 and slidably fitted within a guide tube 9. The guide tube 9 includes a radially outward protruding flange portion 9*a* at its upper end and is fixed to the cylinder head 5 by press-fitting into the cylinder head 5 until the flange portion 9*a* is engaged with an upper surface of the cylinder head 5.

A valve operating system 10 is disposed on the cylinder head 5 and connected to an upper end of the stem 8 of the engine valve V.

The valve operating system 10 includes a casing 11 separatably coupled to the upper surface of the cylinder head 5, an armature 12 movably accommodated in the casing 11 and operatively connected to the stem 8 of the engine valve V, a valve-opening electromagnet 13 disposed within the casing 11 at a location in which it is opposed to a lower surface of the armature 12 to exhibit an electromagnetic force for attracting the armature 12 to open the engine valve V, a valve-closing electromagnet 14 disposed within the casing 11 at a location in which it is opposed to the upper surface of the armature 12 to exhibit an electromagnetic force for attracting the armature 12 to close the engine valve V, a valve-opening coil spring 15 as a valve-opening resilient means for exhibiting a resilient force for biasing the engine valve V in an opening direction, and a valve-closing coil spring 16 as a valve-closing resilient means for exhibiting a resilient force for biasing the engine valve V in a closing direction and for retaining the armature 12 at a predetermined neutral portion by cooperation with the valve-opening coil spring 15 during deenergization of the valve-opening and valve-closing electromagnets 13 and 14.

The casing 11 is comprised of a casing body 17 extending coaxially with the stem 8 of the engine valve. V to define an accommodating bore 19 with its upper end opened, and a lid plate 18 fixed to an upper surface of the casing body 17. The lid plate 18 is fastened to the upper surface of the casing body 17 by a plurality of bolts 20, so that it closes an upper end of the accommodating bore 19.

A plurality of vertically extending support sections 21 are integrally provided at a lower portion of an outer periphery of the casing body 17, and fastening bolts 22 are inserted through the support sections 21, respectively. The casing 11 is fastened to the upper surface of the cylinder head 5 by threaded fitting of the fastening bolts 22 into the cylinder head 5.

A support collar 24 is integrally provided at a lower end of the casing 11, i.e., of the casing body 17 and protrudes radially inwards from an inner surface of the accommodating bore 19. A support tube 25 is threadedly engaged with female threads 27 provided on an inner periphery of the support collar 24 for advancing and retreating movements in a direction coaxial with the stem 8 of the engine valve V. A retaining nut 28 engaged with a lower surface of the support collar 24 is threadedly engaged with the support tube 25. Thus, the support tube 25 can be firmly fixed to the support collar 24, i.e., the lower end of the casing 11 for advancing and retreating movements in the direction coaxial with the stem 8 by a double-nut structure formed by the threaded engagement of the support tube 25 with the support collar 24 and the threaded engagement of the retaining nut 28 with the support tube 25.

A cylindrical portion 30 defining a support bore 29 coaxial with the stem 8 is integrally provided at the upper end of the casing 11, i.e., on the lid plate 18 to protrude upwards. A cylindrical regulating member 31 is slidably fitted into the support bore 29 for movement in the axial direction of the stem 8 and has a through-hole 32 provided therein over its entire vertical length.

A cap nut 34 is threadedly fitted over the cylindrical portion 30, so that an upper end of the regulating member 31 abuts against a closed end of the cap nut 34, and a retaining nut 35 is threadedly fitted over the cylindrical portion 30 to set the advanced or retreated position of the cap nut 34. Thus, a double-nut structure is formed by the cap nut 34 and the retaining nut 35, and the end of the axially outward movement of the regulating member 31 can be adjustably and firmly limited by adjusting the advanced or retreated position of the cap nut 34. A bore 36 is provided in a closed end of the cap nut 34 and coaxially communicates with a through-bore 32 in the regulating member 31.

An upper portion of the stem 8 of the engine valve V is inserted from below into the casing body 17, so that it is coaxially passed through the support tube 25, and the armature 12 is fixed to the upper end of the stem 8. More specifically, the armature 12 is formed into a disk-like configuration, and the upper end of the stem 8 that is passed through a center portion of the armature 12 is press-fitted into a pair of upper and lower rings 37 and 38. The center portion of the armature 12 is clamped by both the rings 37 and 38.

A cap-like receiving member 39 is mounted to abut against the upper surface of the cylinder head 5 to cover the flange portion 9*a* of the upper end of the guide tube 9. The valve-closing coil spring 16 is mounted between the ring 38 and the receiving member 39 to surround the stem 8 axially movably passed through the receiving member 39, so that the stem 8, i.e., the engine valve V, is resiliently biased in a closing direction by a spring force of the valve-closing coil spring 16. Moreover, a ring-like seal member 40 in sliding contact with the outer surface of the stem 8 is retained within the receiving member 39. The valve-opening coil spring 15 is mounted between the ring 37 and the regulating member 31, so that the armature 12 is resiliently biased downwards by the spring force of the valve-opening coil spring 15, i.e., in an opening direction of the engine valve V.

Figure 2:
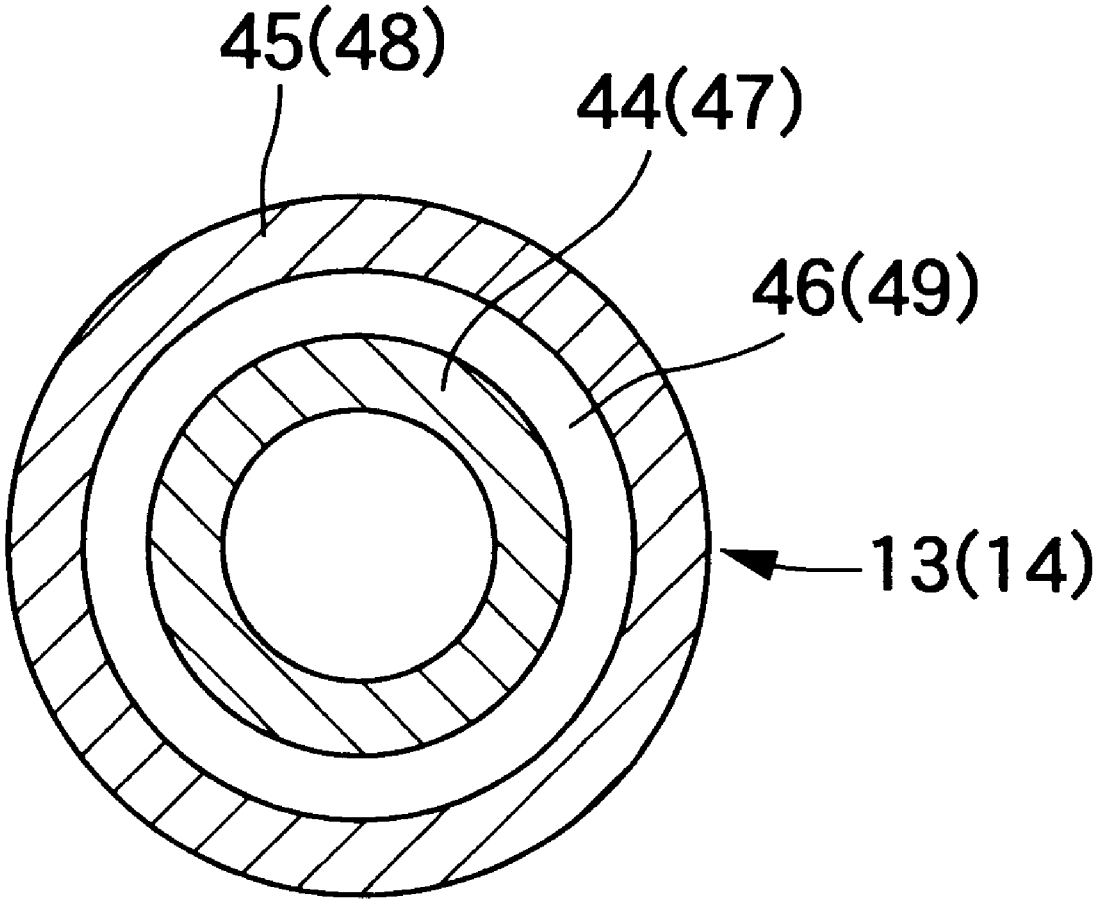

Referring also to FIG.2, the valve-opening electromagnet 13 is fixedly disposed in a lower portion of the accommodating bore 19, so that it is opposed to the lower surface of the armature 12. The valve-opening electromagnet 13 includes a cylindrical inner yoke 44 coaxially surrounding the stem 8 and the valve-closing coil spring 16, a cylindrical outer yoke 45 fitted in the accommodating bore 19 to coaxially surround the inner yoke 44, and a ring-like coil assembly 46 which has a coil wound around a bobbin made of a synthetic resin and which is fitted between the inner and outer yokes 44 and 45. A radially outward protruding flange portion 44*a* is integrally provided at a lower end of the inner yoke 44 and has an outer edge engaged with a lower end of the outer yoke 45. That is, the valve-opening electromagnet 13 is comprised of the coil 46 inserted between the inner and outer yokes 44 and 45 which are disposed in the form of a double-cylinder such that they open at their ends opposed to the armature 12 and are magnetically coupled to each other at their sides opposite from the armature 12. The coil 46 protrudes in a protrusion amount L from both the yokes 44 and 45 toward the armature 12. A groove-like annular accommodating portion 42 is provided in a surface of the armature 12 opposed to the valve-opening electromagnet 13 and is capable of accommodating that portion of the coil 46 which protrudes from both the yokes 44 and 45.

The valve-closing electromagnet 14 is fixedly disposed in an upper portion of the accommodating bore 19, so that it is opposed to the upper surface of the armature 12. The cross-sectional view of the valve-closing electromagnet 14 is the same as the valve-opening electromagnet 13 so the numerals for the valve-closing electromagnet 14 as shown in parenthesis in FIG. 2. The valve-closing electromagnet 14 includes a cylindrical inner yoke 47 coaxially surrounding the regulating member 31 and the valve-opening coil spring 15, a cylindrical outer yoke 48 fitted in the accommodating bore 19 to coaxially surround the inner yoke 47, and a coil 49 which is fitted between the inner and outer yokes 47 and 48. A radially outward protruding flange portion 47*a* is integrally provided at an upper end of the inner yoke 47 and has an outer edge engaged 14 with an upper end of the outer yoke 48. That is, the valve-closing electromagnet 14 is comprised of the coil 49 inserted between the inner and outer yokes 47 and 48 which are disposed in the form of a double cylinder such that they open at their ends opposed to the armature 12 and are magnetically coupled to each other at their sides opposite from the armature 12. The coil 49 protrudes in a protrusion amount L from both the yokes 47 and 48 toward the armature 12. A groove-like annular accommodating portion 43 is provided in a surface of the armature 12 opposed to the valve-closing electromagnet 14 and is capable of accommodating that portion of the coil 49 which protrudes from both the yokes 47 and 48.

The ratio of the area of the magnetic path in the outer yoke 45, 48 to that in the inner yoke 44, 47, i.e., the ratio of the cross sectional area of the outer yoke 45, 48 to that of the inner yoke 44, 47 in each of the electromagnets 13 and 14 is set in a range of 1.0 to 1.4.

A sleeve 50 is fitted into the accommodating bore 19 in a ring-like configuration to surround the armature 12 and is interposed between the outer yoke 45 of the valve-opening electromagnet 13 and the outer yoke 48 of the valve-closing electromagnet 14. The lower end of the inner yoke 44 of the valve-opening electromagnet 13 is supported in an abutting manner on the upper end of the support tube 25. A shim 51 is interposed between the upper end of the inner yoke 47 of the valve-closing electromagnet 14 and the lid plate 18 of the casing 11. More specifically, the valve-opening and valve-closing electromagnets 13 and 14 with the sleeve 50 interposed therebetween are fixed within the casing 11 by clamping thereof between the shim 51 disposed at the upper end of the casing 11 and the upper end of the support tube 25.

A grommet 52 is fitted in that lower end portion of the casing body 17 which corresponds to the support collar 24. A pair of lead wires 53 connected to the coil 46 of the valve-opening electromagnet 13 are passed through the grommet 52 and extend outwards of the casing 11. A grommet 54 is fitted in the lid plate 18, and a pair of lead wires 55 connected to the coil 49 of the valve-closing electromagnet 14 are passed through the grommet 54 and extend outwards of the casing 11.

The members located near the valve-opening electromagnet 13 and the valve-closing electromagnet 14, i.e., the engine valve V, the valve-opening coil spring 15, the valve-closing coil spring 16, the rings 37 and 38, the regulating member 31, the receiving member 39, the casing body 17, the sleeve 50, the support tube 25 and the like are formed from a non-magnetic light material. Any material, such as titanium alloy, an aluminum alloy, a ceramic material and the like may be selected as the non-magnetic light material.

Figure 3:
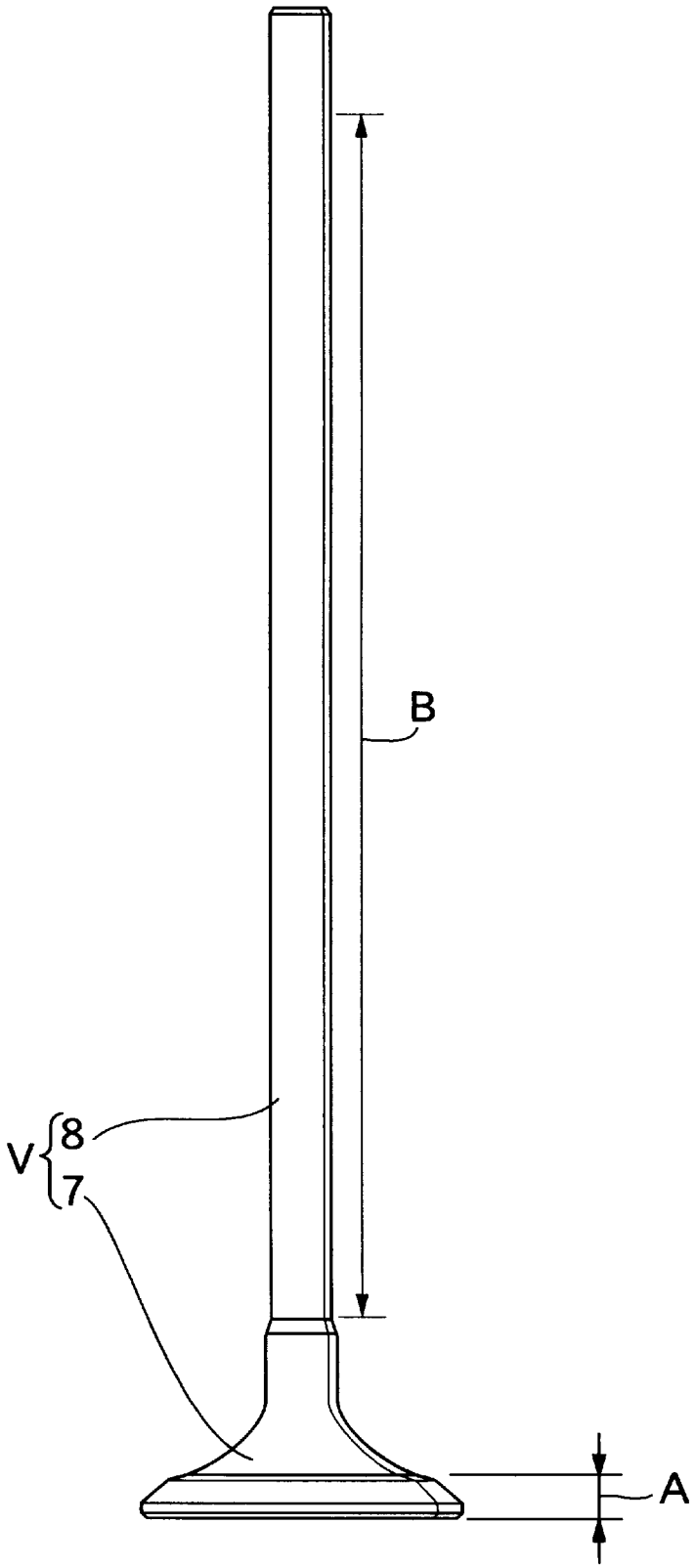

When the engine valve V is formed from a ceramic material, it is unnecessary to subject the engine valve to a surface hardening treatment. However, when the engine valve V is formed from a titanium alloy or an aluminum alloy, the portion of the engine valve V which contacts the valve seat member 6 as well as the portion of the engine valve V which contacts the guide tube 9 is subjected to a surface hardening treatment. More specifically, when the engine valve V is formed from a titanium alloy, the surface of the valve member 7 of the engine valve V in a region A of contact with the valve seat member 6 in FIG.3 is subjected to a build-up treatment using a chromium carbide ($Cr_3C_2$). When the engine valve V is formed from an aluminum alloy, the surface of the valve member 7 of the engine valve V in the region A of contact with the valve seat member 6 in FIG.3 is subjected to a thermal spraying treatment using an iron-chromium carbide (Fe—Cr—C) based material. When the engine valve V is formed from a titanium alloy, the surface of the stem 8 of the engine valve V in a region B of sliding contact with the guide tube 9 is subjected to a thermal spraying treatment. More specifically, when the engine valve V is formed from an aluminum alloy, the surface of the stem 8 of the engine valve V in the region B of contact with the guide tube 9 is subjected to an Fe plating treatment.

The operation of the first embodiment will be described below. Each of the valve-opening and valve-closing electromagnets 13 and 14 is comprised of the coil 46, 49 inserted between the inner yoke 44, 47 and the outer yoke 45, 48 disposed in the form of a double-cylinder such that they open at their ends opposed to the armature 12 and are magnetically coupled to each other at their ends opposite from the armature 12, and in such a manner that the coil 46, 49 protrudes from the yokes 44, 45 and 47, 48 toward the armature 12. The annular accommodating portion 42, 43 capable of accommodating that portion of the coil 46, 49 which protrudes from the yokes 44, 45 and 47, 48 is provided in the surface of the armature 12 opposed to the electromagnet 13, 14, respectively. Therefore, when the armature 12 is attracted to each of the electromagnets 13 and 14, a portion of the corresponding coil 46, 49 is accommodated in the corresponding annular accommodating portion 42, 43 of the armature 12.

Figure 4:
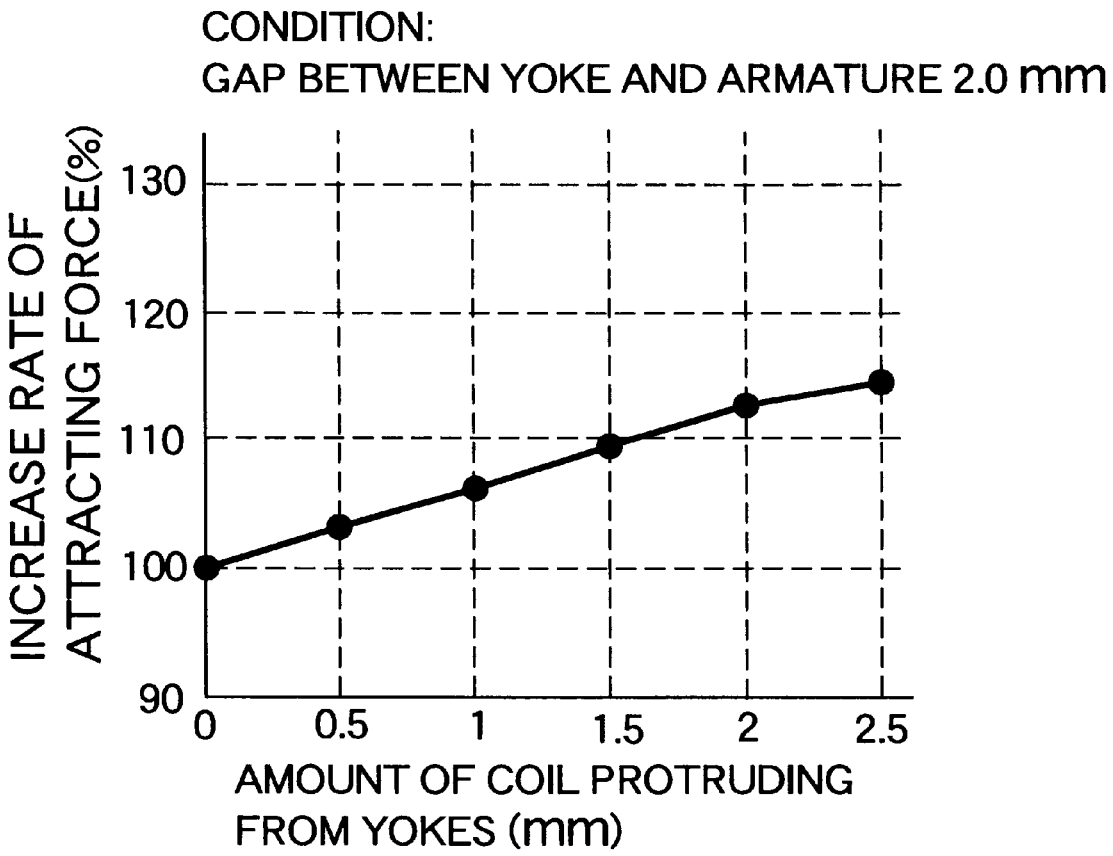

The magnetic field is highest at that portion of each of the electromagnets 13 and 14 which corresponds to the extending end of the corresponding coil 46, 49. Thus, an increase in magnetic flux between the armature 12 and both the yokes 44, 45, and 47, 48 by the fact that the coil 46, 49 protrudes from the yokes 44, 45 and 47, 48 toward the armature 12, and the portion of the coil 46, 49 protruding from the yokes 44, 45 and 47, 48 is accommodated in the corresponding annular accommodating portion 42, 43 of the armature 12. In other words, as the amount of coil 46, 49 protruding from the yokes 44, 45 and 47, 48 toward the armature 12 is increased, the attracting force of the electromagnet 13, 14 is increased, as shown in FIG.4, for the same gap of 2.0 mm between the yokes and armature.

Figure 5:
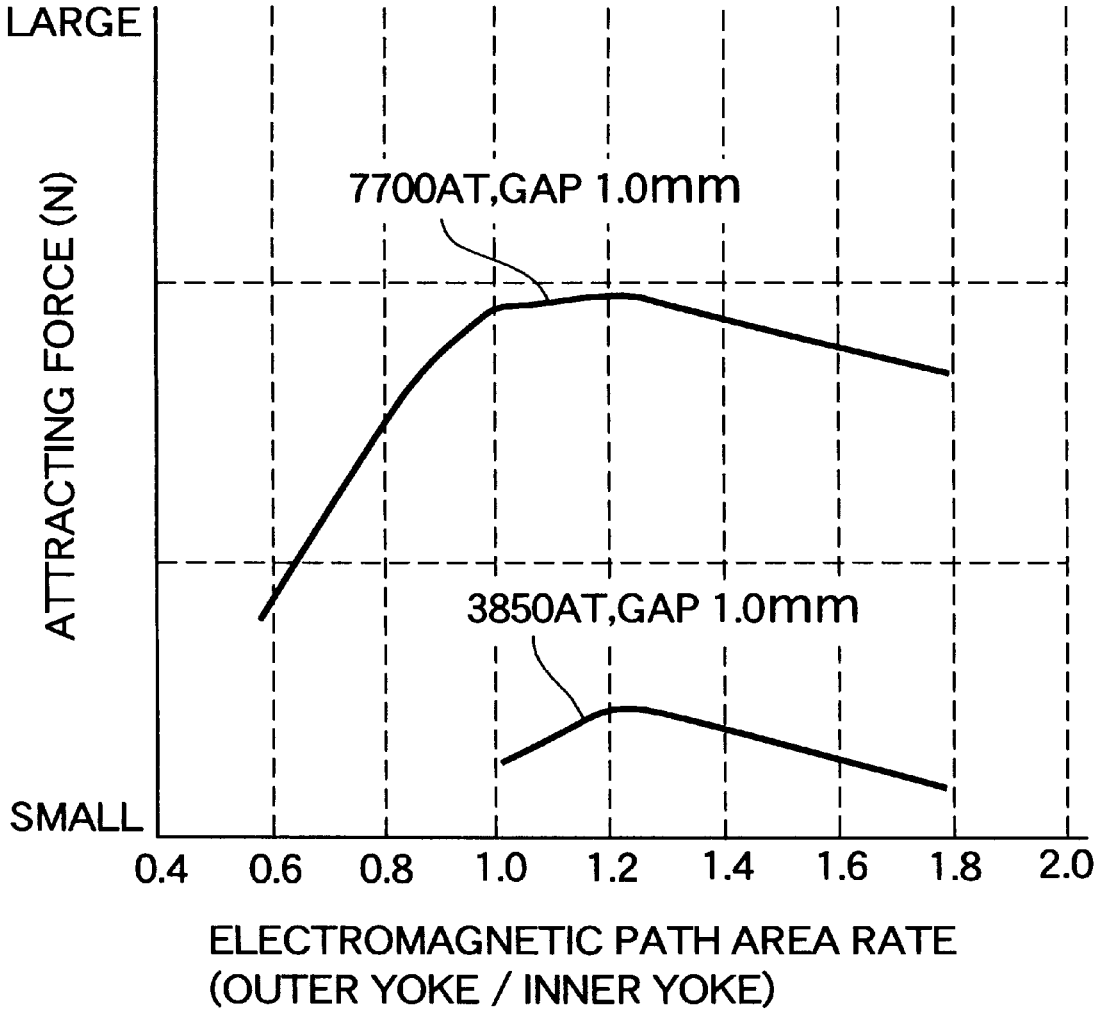

The attracting force is varied, as shown in FIG.5, in accordance with the ratio of the area of the magnetic path in the outer yoke 45, 48 to that in the inner yoke 44, 47. Here, AT is a unit represented by a product of the electric current A and the number of turns of the coil. It is apparent that even if the value of AT is constant, the attracting force of the electromagnet 13, 14 can be increased by setting the magnetic path area ratio in the range of 1.0 to 1.4, preferably at 1.2.

Moreover, by the fact that the engine valve V, the valve-opening coil spring 15, the valve-closing coil spring 16, the rings 37 and 38, the regulating member 31, the receiving member 39, the casing body 17, the sleeve 50, the support tube 25 and the like are formed from non-magnetic light-weight materials, the leakage of the magnetic flux from the electromagnets 13 and 14 can be reduced to the utmost, and an increased attractive force can be ensured by a decrease in weight of the engine valve which is a movable member. Further, since the portion of the engine valve V which is in contact with the valve seat means 6 and the portion of the engine valve V which is in sliding contact with the guide tube 9 are subjected to the surface hardening treatment, enhancements in seizure resistance and wear resistance can be provided, notwithstanding that a non-magnetic and lightweight material has been used.

Figure 6:
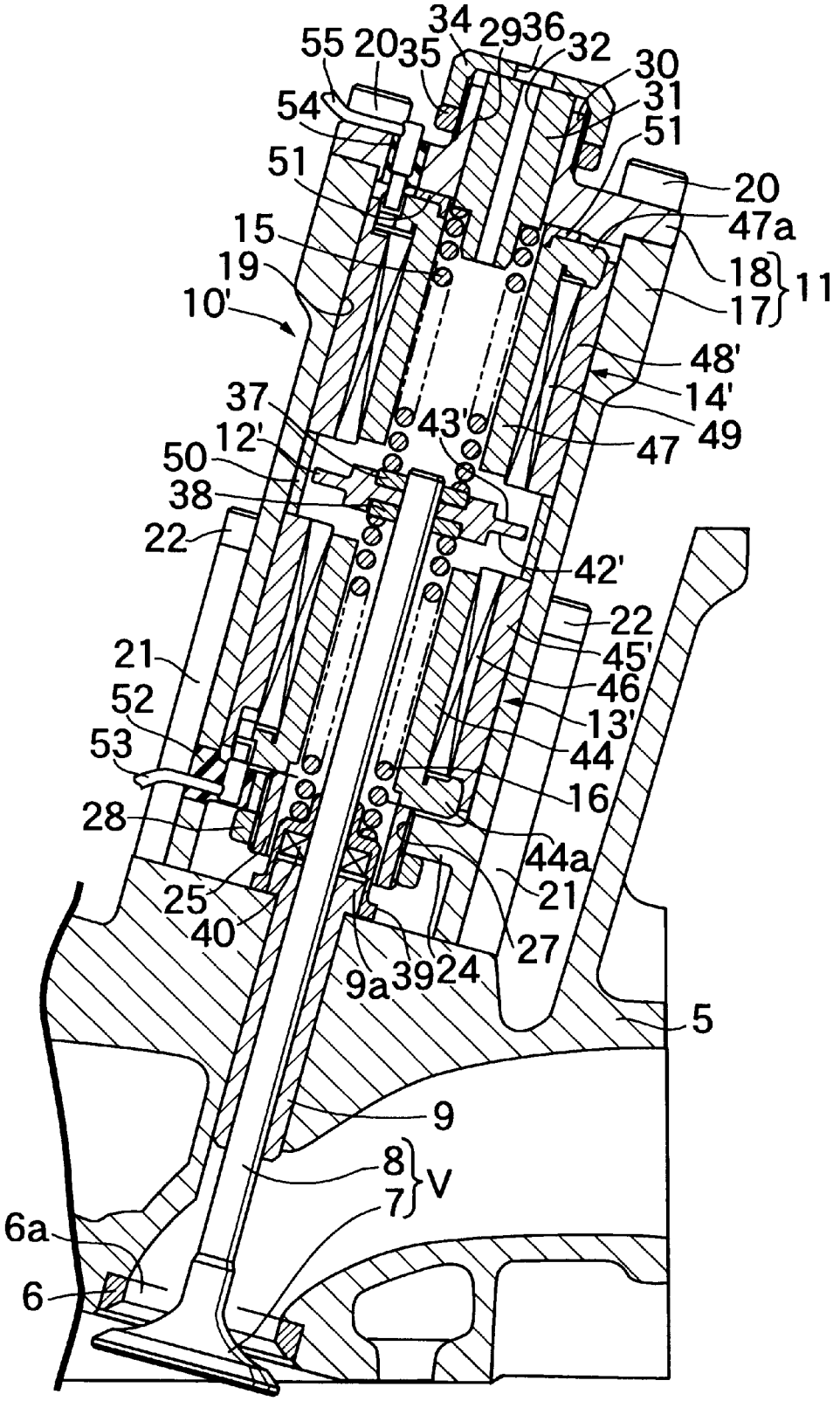
FIG. 6 is a vertical sectional view similar to FIG. 1, but according to a second embodiment of the present invention.

FIG.6 shows a second embodiment of the present invention, wherein portions or components corresponding to those in the first embodiment are designated by like reference characters.

In a valve operating system 10' of FIG. 6, a valve-opening electromagnet 13' includes a coil 46 inserted between an inner yoke 44 and an outer yoke 45', which yoke 45' protrudes toward an armature 12' more than the inner yoke 44, so that the coil 46 also protrudes toward the armature 12' more than the inner yoke 44. A valve-closing electromagnet 14' includes a coil 49 inserted between an inner yoke 47 and an outer yoke 48', which yoke 48' protrudes toward an armature 12' more than the inner yoke 47, so that the coil 49 also protrudes toward the armature 12' more than the inner yoke 47.

Annular accommodating portions 42' and 43' are formed on the armature 12' by making the outer peripheral portion of the armature 12' thin and are capable of accommodating that portion of the coil 46 which protrudes from the inner yoke 44 and that portion of coil 49 which protrudes from the inner yoke 47, respectively.

Further, in each of the electromagnets 13' and 14', the ratio of the area of the magnetic path in the outer yoke 45', 48' to that area in the inner yoke 44, 47 is set in a range of 1.0 to 1.4.

Even in the second embodiment, an effect similar to that in the first embodiment can be provided.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating system for an internal combustion engine, comprising an armature operatively connected to an engine valve, a valve-opening electromagnet for exhibiting an electromagnetic force for attracting said armature to open said engine valve, a valve-closing electromagnet for exhibiting an electromagnetic force for attracting said armature to close said engine valve, a valve-opening resilient means for exhibiting a resilient force for biasing said engine valve in a valve opening direction, and a valve-closing resilient means for exhibiting a resilient force for biasing said engine valve in a valve closing direction and for maintaining said armature at a predetermined neutral position by cooperation with said valve-opening resilient means during deenergization of said valve-opening and valve-closing electromagnets, wherein each of said valve-opening and valve-closing electromagnets includes a coil inserted between inner and outer yokes which are disposed in the form of a double-cylinder such that they open at their ends opposed to the armature and are magnetically coupled to each other at their ends opposite from said armature, so that each of said coils has a portion that protrudes from at least one of said yokes toward said armature, and said armature has an annular accommodating portion provided in a surface thereof opposed to each of said electromagnets and shaped for accommodating said portion of said coil which protrudes from each of said yokes.

2. A valve operating system for an internal combustion engine, comprising an armature operatively connected to an engine valve, a valve-opening electromagnet for exhibiting an electromagnetic force for attracting said armature to open said engine valve, a valve-closing electromagnet for exhibiting an electromagnetic force for attracting said armature to close said engine valve, a valve-opening resilient means for exhibiting a resilient force for biasing said engine valve in a valve opening direction, and a valve-closing resilient means for exhibiting a resilient force for biasing said engine valve in a valve closing direction and for maintaining said armature at a predetermined neutral position by cooperation with said valve-opening resilient means during deenergization of said valve-opening and valve-closing electromagnets, wherein each of said valve-opening and valve-closing electromagnets includes a coil inserted between inner and outer yokes which are disposed in the form of a double-cylinder such that they open at their ends opposed to said armature and are magnetically coupled to each other at their ends opposite from said armature, and a ratio of a cross-sectional area of a magnetic path in said outer yoke to a cross-sectional area of a magnetic path in said inner yoke is set in a range of 1.0 to 1.4.

3. A valve operating system for an internal combustion engine according to claim 1 or 2, wherein members are located near said valve-opening and valve-closing electromagnets and said members include said engine valve; at least said engine valve of said members is formed from a non-magnetic lightweight material, and at least said engine valve contacting with another member formed of a non-magnetic lightweight material has a portion thereof contacting with another of said members that has been subjected to a surface hardening treatment.

4. A valve operating system for an internal combustion engine according to claim 2, wherein each said coil has a portion that protrudes toward said armature from at least one of said yokes in which said coil is inserted, and said armature has an annular accommodating portion provided in a surface thereof opposed to each of said electromagnets and shaped for accommodating said portion of said coil which protrudes from said yokes.

5. A valve operating system for an internal combustion engine according to claim 1 or 4, wherein each said coil protrudes from both the inner yoke and the outer yoke between which said coil is inserted.

* * * * *